US008402977B2

(12) United States Patent
McCormack

(10) Patent No.: US 8,402,977 B2
(45) Date of Patent: Mar. 26, 2013

(54) TOBACCO SMOKE FILTER

(75) Inventor: Anthony Denis McCormack, Wylam (GB)

(73) Assignee: Filtrona International Limited, Milton Keynes (GB)

( * ) Notice: Subject to any disclaimer, the term of this patent is extended or adjusted under 35 U.S.C. 154(b) by 1312 days.

(21) Appl. No.: 10/536,943

(22) PCT Filed: Nov. 26, 2003

(86) PCT No.: PCT/GB03/05151

§ 371 (c)(1),
(2), (4) Date: Oct. 17, 2005

(87) PCT Pub. No.: WO2004/047571

PCT Pub. Date: Jun. 10, 2004

(65) Prior Publication Data

US 2006/0130856 A1 Jun. 22, 2006

(30) Foreign Application Priority Data

Nov. 27, 2002 (GB) ..... 0227662.4

(51) Int. Cl.
*A24F 1/20* (2006.01)

(52) U.S. Cl. ..... 131/207; 131/352; 131/290; 131/331; 131/334; 131/360; 432/66; 432/67; 432/214; 432/215

(58) Field of Classification Search ..... None
See application file for complete search history.

(56) References Cited

U.S. PATENT DOCUMENTS

| | | | | |
|---|---|---|---|---|
| 3,108,142 | A * | 10/1963 | Baur et. al. | 585/269 |
| 3,636,957 | A | 1/1972 | Saffer, Jr. | |
| 5,187,141 | A * | 2/1993 | Jha et al. | 502/432 |

FOREIGN PATENT DOCUMENTS

| | | | |
|---|---|---|---|
| JP | 60-27375 | A | 2/1985 |
| RU | 2 064 281 | C1 | 7/1996 |
| WO | WO 02/37990 | A2 | 5/2002 |

OTHER PUBLICATIONS

Garrido, Julian et al., The effect of Gasification by Air or CO2 in the Development of Microporosity in Activated Carbons, 1987. J. Chem. Soc., Faraday Trans. 1, 83, 1081-1088.*
Search Report dated Feb. 12, 2003 in UK Application No. GB 0227662.4 (1 page).
International Search Report mailed Jul. 27, 2004 in PCT/GB03/05151 (3 pages).
Lee, Y-S et al., "Preparation and characterization of trilobal activated carbon fibers", *Carbon*, vol. 41, , No. 13, 2003, pp. 2573-2584.

* cited by examiner

*Primary Examiner* — Richard Crispino
*Assistant Examiner* — Phu Nguyen
(74) *Attorney, Agent, or Firm* — Flynn, Thiel, Boutell & Tanis, P.C.

(57) ABSTRACT

A tobacco smoke filter which gives an acceptable vapor phase filtration and flavor delivery in the presence of a volatile flavorant (e.g. menthol), the filter containing activated carbon in which (1) pores of under 2 nm pore diameter (micropores) provide a pore volume of at most 0.3 $cm^3/g$ (NZ); and (2) (a) pores of 2 to 50 nm pore diameter (mesopores) provide a pore volume of at least 0.25 $cm^3/g$ ($N_2$) and/or (b) pores of 7 to 50 nm diameter (larger mesopores) provide a pore volume of at least 0.12 $cm^3/g$ (Hg).

11 Claims, No Drawings

TOBACCO SMOKE FILTER

This invention relates to tobacco smoke filters containing a particulate sorbent.

Use of sorbent particles to remove vapour phase (VP) components from tobacco smoke is well known. Cigarettes containing a volatile flavourant (e.g. menthol) are also well known. However, prior attempts to use both a volatile flavourant and a particulate sorbent in a filter cigarette have been unsuccessful, it having been proved impossible to provide a satisfactory level of flavour delivery whilst maintaining a satisfactory level of VP constituent removal by the particulate sorbent.

We have found that this problem can be overcome by a tobacco smoke filter containing activated carbon in which (1) pores of under 2 nm pore diameter (micropores) provide a pore volume of at most 0.3 $cm^3/g$ ($N_2$); and (2) (a) pores of 2 to 50 nm pore diameter (mesopores) provide a pore volume of at least 0.25 $cm^3/g$ ($N_2$) and/or (b) pores of 7 to 50 nm diameter (larger mesopores) provide a pore volume of at least 0.12 $cm^3/g$ (Hg). An activated carbon without micropore volume has poor VP removal performance which is reduced yet further or nullified in the presence of a volatile flavourant, and the indicated micro/meso pore combinations are necessary to permit the required balance of flavour delivery and VP removal. Herein, a pore volume expressed in $cm^3/g$ ($N_2$) means said volume as measured by nitrogen porosimetry, using a Micromeritics Tristar 3000 for measurement of the nitrogen adsorption/desorption isotherms and characterising the pore size distribution via the BJH method on the desorption branch of the isotherm. A pore volume or surface area expressed in $cm^3/g$ (Hg) or $m^2/g$ (Hg) means said value as measured by mercury porosimetry using a contact angle of 140° and a surface tension value of 480 dynes/cm.

Accordingly the present invention provides a tobacco smoke filter containing activated carbon which carbon has a micropore volume provided by micropores of under 2 nm pore diameter, said micropore volume being up to 0.3 $cm^3/g$ ($N_2$), and in which carbon mesopores of 2 to 50 nm pore diameter provide a mesopore volume of at least 0.25 $cm^3/g$ ($N_2$); such a filter wherein at least 0.12 $cm^3/g$ (Hg) of said mesopore volume is provided by mesopores of 7 to 50 nm pore diameter; and a tobacco smoke filter containing activated carbon which carbon has a micropore volume provided by micropores of under 2 nm pore diameter, said micropore volume being up to 0.3 $cm^3/g$ ($N_2$), and in which carbon mesopores of 7 to 50 nm pore diameter provide a mesopore volume of at least 0.12 $cm^3/g$ (Hg). In the activated carbon used according to the invention pores of over 50 nm pore diameter (macropores) preferably provide a pore surface area of at least 5 $m^2/g$ (Hg), most preferably 6 or more $m^2/g$ (Hg).

The designation of pores of less than 2 nm, 2 to 50 nm, and over 50 nm size (diameter) as micro-, meso- and macro-pores is in accord with accepted IUPAC terminology and definition.

The micropore volume provided by said micropores is preferably at most 0.26 $cm^3/g$ ($N_2$), more preferably 0.15 $cm^3/g$ ($N_2$) or less. The mesopore volume provided by said 2 to 50 nm mesopores may for example be about 0.3 $cm^3/g$ ($N_2$) and is preferably over 0.4 or over 0.5 $cm^3/g$ ($N_2$); the preferred range is thus from 0.3 to 0.5 or higher $cm^3/g$ ($N_2$). The mesopore volume provided by the 7 to 50 nm larger mesopores is preferably 0.13 $cm^3/g$ (Hg) or higher, and can be over 0.3 or over 0.5 $cm^3/g$ (Hg); the preferred range is thus from 0.13 to 0.5 or higher $cm^3/g$ (Hg).

We have most unexpectedly found that activated carbon of such a carefully controlled micro/meso porosity—and preferably micro/meso/macro porosity—(a) shows a satisfactory level of adsorption of a volatile flavourant such as menthol (not too little and not too much); (b) releases a sufficient amount of the flavourant during smoking conditions to deliver a satisfactory taste; (c) shows a good adsorption of VP components from tobacco smoke; and (d) retains a satisfactory (albeit reduced) level of this VP removal, even in the presence of a volatile flavourant such as menthol. This combination of properties has not heretofore been attainable.

Accordingly, the invention also provides a tobacco smoke filter according to the invention incorporated in a filter cigarette containing a volatile flavourant—e.g, menthol. Such a filter cigarette provides for the first time the combination of flavour delivery to give an acceptably flavoured taste with an acceptable reduction in delivery of VP smoke components.

The filter according to the invention may be of any design previously proposed for particulate sorbent-containing tobacco smoke filters. For example the carbon may be dispersed throughout a filter plug, carried on the tow or fibres or sheet material which is gathered to form the plug; it may instead by adhered to one or more threads which extend through the matrix of the filter plug or be adhered to the inner face of a wrapper around the filter plug; or it may form a bed sandwiched between a pair of plugs (e.g. of cellulose acetate tow) in a common wrapper. The carbon may be treated with the flavourant prior to filter production so that it acts as a carrier for the flavourant and minimises migration of the flavourant during storage. Instead, the carbon could be used in a suitable filter in the unflavoured state, with the flavourant being added to another part of the filter and/or to the cigarette with which the filter is used and/or to the filter cigarette packaging. The flavourant might be carried on a wrapper around a filter plug or on one or more threads through a filter plug, and such a plug may be the plug which also carries the activated carbon or a separate plug.

Filters according to the invention may additionally include one or more particulate sorbents other than the activated carbon required by the invention (e.g. silica gel, or a different carbon), mixed with the carbon required by the invention and/or separate from this.

The invention is illustrated by the following Examples, in which Examples B, C, D and H are according to the invention and the remainder are comparisons.

EXAMPLES

For each Example, a sample of the respective activated carbon was dried and exposed to a menthol atmosphere in a desiccator at 55° C. for 4 days, and the increase in weight was recorded. "Triple granular" cigarette filters were then assembled, each containing 100 mg of the mentholated carbon in a packed bed between two cellulose acetate filter segments. The filter cigarettes were smoked under ISO conditions (35 $cm^3$ puffs, each of two seconds duration, taken once per minute) and the menthol yields from the cigarettes were measured. The vapour phase of cigarette smoke was also collected and the percentage reduction of a selected number of vapour phase compounds measured; the mean reduction in these VP compounds, and the reduction obtained from an equivalent filter with 100 mg of the same carbon prior to exposure to menthol, were measured relative to an equivalent filter cigarette with no carbon.

The results are summarised in the following Table which gives the porosity parameters for the various carbons employed and the measured performances of the filters using them. Examples B, C, D and H used activated carbons according to the requirements of the invention, whilst the remainder did not. Comparison Example A used a standard coconutbased carbon as typically used in prior cigarette filters, whilst Comparison Examples E to G and I to M used other carbons whose micro/meso/macro porosity led to poor results. Comparison Example K showed good menthol uptake and yield, but with immeasurably low carbon micropore volume its VP removal performance was low and reduced to substantially zero in the presence of menthol. Comparison Examples I, J, L and M showed active VP removal after mentholation but gave markedly inadequate menthol yield, whilst the remaining Comparison Examples (A and E to G) were markedly inadequate for both VP removal and menthol yield.

TABLE

| | EXAMPLE | | | | | | |
|---|---|---|---|---|---|---|---|
| | A | B | C | D | E | F | G |
| Micropore Volume - ($cm^3/g$) ($N_2$) | 0.46 | 0.26 | 0.11 | 0.12 | 0.52 | 0.33 | 0.23 |
| 2-50 nm Mesopore Volume -$cm^3/g$ ($N_2$) | 0.09 | 0.30 | 0.44 | 0.51 | 0.36 | 0.25 | 0.04 |
| 7-50 nm Mesopore Volume -$cm^3/g$ (Hg) | 0.06 | 0.13 | 0.34 | 0.54 | 0.21 | 0.15 | na * |
| Macropore Area -$m^2/g$ (Hg) | 1.9 | 6.4 | 6.9 | 12.2 | 1.4 | 4.9 | na * |
| Menthol Uptake % | 18.6 | 27.3 | 27.5 | 23 | 57.1 | 18.9 | 11.5 |
| Menthol Yield (mg/cig) | 0.03 | 0.73 | 0.44 | 0.72 | 0.07 | 0.06 | 0.15 |
| Mean VP (unmentholated) (%) | 53 | 85 | 45 | 61 | 85 | 45 | 47 |
| Mean VP (mentholated) (%) | <5 | 24 | 24 | 36 | <5 | <5 | <5 |

| | EXAMPLE | | | | | |
|---|---|---|---|---|---|---|
| | H | I | J | K | L | M |
| Micropore Volume - ($cm^3/g$) ($N_2$) | 0.19 | 0.35 | 0.43 | nm * | 0.50 | 0.31 |
| 2-50 nm Mesopore Volume -$cm^3/g$ ($N_2$) | 0.29 | 1.05 | 0.92 | 0.49 | 1.10 | 0.28 |
| 7-50 nm Mesopore Volume -$cm^3/g$ (Hg) | 0.13 | 0.20 | 0.29 | na * | 0.21 | 0.10 |
| Macropore Area -$m^2/g$ (Hg) | 8.0 | 2.8 | 1.1 | na * | 2.5 | 3.7 |
| Menthol Uptake % | 20 | 34.6 | 34.9 | 39.7 | 39.1 | 20 |
| Menthol Yield (mg/cig) | 0.58 | 0.08 | 0.12 | 0.99 | 0.04 | 0.00 |
| Mean VP (unmentholated) (%) | 79 | 87 | 75 | 27 | 91 | 55 |
| Mean VP (mentholated) (%) | 25 | 46 | 45 | 0 | 30 | 35 |

* na—not ascertained
* nm—effectively zero - too small to measure

The invention claimed is:

1. A tobacco smoke filter containing activated carbon having micropores of under 2 nm pore diameter and first mesopores having a pore diameter of 2 to 50 nm and second mesopores having a pore diameter of 7 to 50 nm pore diameter, and a flavourant, the micropores having a micropore volume at most 0.3 $cm^3/g$ ($N_2$), the first mesopores having a mesopore volume of at least 0.25 $cm^3/g$ ($N_2$) and the second mesopores having a mesopore volume of at least 0.12 $cm^3/g$ (Hg); wherein the first mesopores and the second mesopores having different pore diameters and different mesopore volumes.

2. A tobacco smoke filter according to claim 1 wherein macropores of over 50 nm diameter provide a surface area of at least 5 $m^2/g$ (Hg).

3. A tobacco smoke filter according to claim 1 wherein said micropore volume is at most 0.26 $cm^3/g$ ($N_2$).

4. A tobacco smoke filter according to claim 1 wherein said micropore volume is at most 0.15 $cm^3/g$ ($N_2$).

5. A tobacco smoke filter according to claim 1 wherein said first mesopores having a mesopore volume of about 0.3 $cm^3/g$ ($N_2$).

6. A tobacco smoke filter according to claim 1 wherein said first mesopores having a mesopore volume over 0.4 $cm^3/g$ ($N_2$) or over 0.5 $cm^3/g$ ($N_2$).

7. A tobacco smoke filter according to claim 1 wherein said second mesopores having a mesopore volume of at least 0.13 $cm^3/g$ (Hg).

8. A tobacco smoke filter according to claim 1 wherein said second mesopores having a mesopore volume over 0.3 $cm^3/g$ (Hg).

9. A filter cigarette containing a tobacco smoke filter of claim 1, wherein said flavourant comprises menthol.

10. A filter cigarette according to claim 9, wherein said flavourant is applied to said activated carbon.

11. A tobacco smoke filter according to claim 1 wherein said second mesopores having a mesopore volume over 0.5 $cm^3/g$ (Hg).

* * * * *